US007946785B2

(12) United States Patent
Grosch

(10) Patent No.: US 7,946,785 B2
(45) Date of Patent: May 24, 2011

(54) BLOCKING BODIES AGAINST VEHICLES HAVING WHEELS

(75) Inventor: Hermann Grosch, Nienhagen (DE)

(73) Assignee: Rheinmetall Landsysteme GmbH, Kiel (DE)

( * ) Notice: Subject to any disclaimer, the term of this patent is extended or adjusted under 35 U.S.C. 154(b) by 112 days.

(21) Appl. No.: 12/334,991

(22) Filed: Dec. 15, 2008

(65) Prior Publication Data

US 2009/0162142 A1 Jun. 25, 2009

(30) Foreign Application Priority Data

Dec. 15, 2007 (DE) ..... 10 2007 060 506

(51) Int. Cl.
*E01F 13/12* (2006.01)

(52) U.S. Cl. ..... 404/6

(58) Field of Classification Search ..... 404/6
See application file for complete search history.

(56) References Cited

U.S. PATENT DOCUMENTS

| | | | | |
|---|---|---|---|---|
| 2,346,713 | A | 10/1942 | Walker | |
| 2,325,260 | A * | 7/1943 | May | 256/1 |
| 5,328,292 | A * | 7/1994 | Williams | 404/6 |
| 5,921,703 | A * | 7/1999 | Becker et al. | 404/6 |
| 6,709,190 | B1 * | 3/2004 | Partin | 404/6 |
| D492,038 | S * | 6/2004 | Brown | D25/38 |
| 7,121,760 | B1 * | 10/2006 | Curry, Jr. | 404/6 |
| 2007/0264079 | A1 * | 11/2007 | Martinez et al. | 404/6 |

FOREIGN PATENT DOCUMENTS

| | | |
|---|---|---|
| DE | 646750 | 6/1937 |
| DE | 19509404 C1 | 8/1996 |
| GB | 577929 | 6/1946 |

OTHER PUBLICATIONS

Dupont Webpage Technical Information.
Kevlar Technical Guide.
Webster's New Collegiate Dictionary, defining the word "fold", p. 445 (1977).

* cited by examiner

*Primary Examiner* — Raymond W Addie
(74) *Attorney, Agent, or Firm* — Griffin & Szipl, P.C.

(57) ABSTRACT

A blocking system or blocking body (1) is provided that is composed of at least four means or members (2) that have a common base (3) and in the transport state are pivoted upwards so that the tips (2.1) of all means (2) lie in one plane, wherein the means (2) in the active state are orientated in such a way that at least three tips (2.1) form contact points (9) on a surface (8) and at least the fourth means (2) pointing upwards penetrates one of the wheels when it is run over. This type of crow's foot (blocking body (1)) can be delivered by means of a thrower or by depositing it into the terrain in which the vehicles are situated, and whose continued travel is to be prevented.

20 Claims, 2 Drawing Sheets

BLOCKING BODIES AGAINST VEHICLES HAVING WHEELS

This application claims priority from German Patent Application No. 10 2007 060 506.6, filed Dec. 15, 2007, the entire disclosure of which is incorporated herein by reference.

FIELD OF THE INVENTION

The invention relates to a blocking system formed from several blocking bodies that can be delivered into an area to be blocked off.

BACKGROUND OF THE INVENTION

Non-lethal effectors are gaining increasing importance in asymmetric conflicts. Blocking systems are an important element thereby in order to restrict both vehicles and personnel in their movement possibilities. Such systems are particularly effective when they are used quickly and in a targeted manner in the context of the situation at a safe distance from one's own forces. Systems against vehicles should act in such a way that injury to the crew is excluded as far as possible. For a wide range of effectiveness, such systems are to have the ability to be laid in the shortest time possible in perceived movement directions of vehicles and to stop them.

Classical non-lethal blocking systems against vehicles and personnel are all types of construction-engineering barriers, such as walls, fences, ditches, etc. The disadvantage is that they must be applied preventively with considerable expenditure of time and material, and are stationary and inflexible. It is frequently necessary to monitor their function. In addition, they can be seen and recognized optically from afar. Although these barriers are non-lethal in their effect, they do not always prevent personnel and vehicles from overcoming them.

Barriers by means of barbed wire or the like on the ground or at a specific height do not always have a non-lethal effect. They may lead to injuries. If enough of them are installed, they can stop vehicles. However, this assumes a considerable number of such barriers.

Mine barriers or the like as preventive barriers have a lethality and are widely banned.

DE 195 09 404 C1 describes a device for the enforced stopping of vehicles with elastomer tires. The device is composed of at least one sharp spike that can be scattered and that has a stand ensuring a piercing position into the wheel of the vehicle. This stand is embodied so that further spikes can be inserted into it and is likewise composed of an elastomer material. Through this measure the wheel revolution of a vehicle is impaired effectively, although slowly.

GB 577,929 concerns an obstacle including means by which it is anchored in the ground and a plurality of sharp tips provided with spikes or other offensively shaped wires or rods that are orientated in all directions over the ground, so that they form a type of mushroom. The obstacle is driven into the ground via an anchored screw and then the wires or rods are released.

U.S. Pat. No. 2,346,713 A presents a so-called crow's foot as a means against vehicles with tires. This crow's foot has four hollow arms fixed securely to a sphere, wherein one of these arms points upwards and the other three form the placement area for the foot.

Furthermore a device for throwing blocking means for military blocking obstacles (has been described in DE 646 750 A. The throwing device is composed of a framework in which individual blocking means as resilient expanding rod supports armed with spikes are accommodated in a prepared position. When the device is launched, the blocking means are released so that the blocking means unfold and burrow into the ground.

The object of the invention is to set forth another non-lethal blocking system that can be distributed flexibly in the terrain and in spite of a simple construction is very effective.

SUMMARY OF THE INVENTION

The object is achieved by a first embodiment, in accordance with the present invention, which pertains to a blocking body (1) for restricting the mobility of a vehicle having wheels, wherein the blocking body has the following features: the blocking body (1) can both be laid manually and be shot by means of a throwing unit or the like, and has at least four means (2) that have a common base (3) and are folded in the transport state and in addition are pivoted upwards so that the tips (2.1) of all means (2) lie in one plane, wherein the means (2) in the active state are orientated in such a way that at least three tips (2.1) form contact points (9) on a surface (8) and at least the fourth means (2) pointing upwards penetrates one of the wheels when it is run over.

In accordance with a second embodiment of the present invention, the first embodiment is modified so that the means (2) are blades or spikes that have a surface that causes them to remain in the wheel. In accordance with a third embodiment of the present invention, the second embodiment is further modified so that the means (2) are provided on their surface with barbs (4). In accordance with a fourth embodiment of the invention, the first, second and third embodiments are modified so that the means (2) are composed of metal or another dimensionally stable material. In accordance with a fifth embodiment of the present invention, the first, second, third and fourth embodiments may be further modified so that the means (2) are fastened to a base plate (11).

In accordance with a sixth embodiment of the present invention, the fifth embodiment is further modified so that three of the means (2) are preferably fastened laterally to the base plate (11) and in the swung-open state form a tetrahedron, and the fourth of the means (2) is attached to the upper face of the base plate (11). In accordance with a seventh embodiment of the present invention, the sixth embodiment is further modified so that the laterally attached means (2) are fastened to the base plate (11) via hinges (10), wherein for example leg springs are situated in the hinges (10), which springs pivot the means (2) into the activation position, in which they then lock. In accordance with an eight embodiment of the invention, the first, second, third, fourth, fifth, sixth and seventh embodiments may be further modified so that at the base end a rope or cable (6) is provided that is wound around the base (3), wherein a claw (7) is provided at the free end of the rope (6). In accordance with a ninth embodiment of the invention, the eighth embodiment is further modified so that the rope (7) is fastened to the underside of a base plate (11) or to one of the means (2). In accordance with a tenth embodiment of the invention, the eighth or ninth embodiments are further modified so that the material of the rope (7) is steel, Kevlar, etc. In accordance with an eleventh embodiment of the invention, the first, second, third, fourth, fifth, sixth, seventh, eighth, ninth and tenth embodiments may be further modified so that each of these means (2) has a hole, so that a type of tubule is formed.

In accordance with a twelfth embodiment of the invention, a method for restricting the mobility of a vehicle having wheels is provided, wherein the method has the following features: a blocking body (1) according to one of first through eleventh embodiments is discharged after the direction of movement of the vehicle has been ascertained, wherein the blades (2) are released at the latest at the impact of the blocking body (1) onto a surface (8), so that the blocking body (1) can take up its position, wherein at least one of the means (2) is orientated upwards. Thus, the twelfth embodiment pertains to a method for delivering the blocking system.

The object forming the basis of the invention is to deliver a blocking system composed of a type of crow's foot by means of a thrower or by depositing it into the terrain in which the vehicles are situated whose continued travel is to be prevented. These blocking systems position themselves thereby and as they are run over, press themselves at least with one of the knife-like feet into a tire of the vehicle. The tire loses air and the vehicle comes to a standstill.

To increase this effect it is provided that each of these crow's feet has a hole, so that a type of tubule is formed through which the air can escape from the tire more quickly.

As a further advantageous embodiment, each blocking system or each blocking body has a rope with a claw hook attached to it that as the vehicle continues to travel, winds itself round the wheel axle and blocks the wheel. Alternatively a type of net can also be used that can achieve the same effect.

In a development, blocking systems are delivered into a known movement direction of the vehicles by means of a targeted shooting. This can take place effectively with a so-called precision thrower. By these means the position of the blocking system, its extent and distribution can be fixed effectively. The positioning density is preferably to be selected such that it is probable that a vehicle tire will coincide with a blocking body.

If the delivery takes place by launching or with the aid of a thrower, for example (pneumatically or the like), the triggering system can be implemented mechanically.

For delivery by means of shooting or launching, the blocking device or the blocking system is incorporated folded into a shootable body, for example a projectile body. The blocking body unfolds before or upon impact.

The advantage of these barrier systems is that it is a question of a simple mechanical non-lethal system that stops vehicles, but spares personnel. In addition the blocking bodies can be taken up after the mission is ended and can be reused. This is in particular also because the blocking bodies in the activated state no longer contain any energies.

The positioned blocking bodies have an unlimited effectiveness with regard to time, which is only ended by collecting them.

The invention is to be explained in more detail based on an exemplary embodiment with drawings.

DETAILED DESCRIPTION OF THE INVENTION

Figure 1:
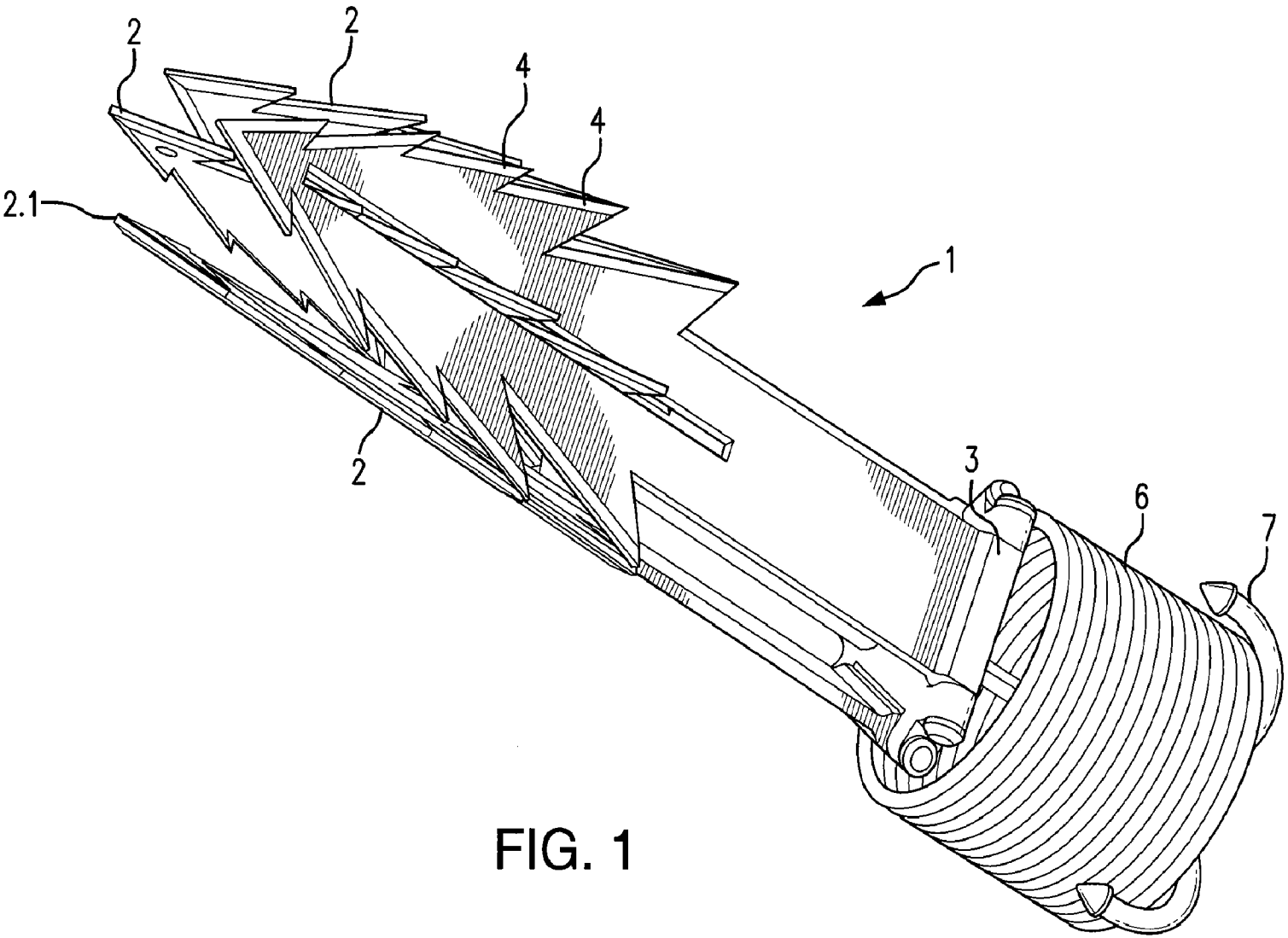
FIG. 1, which illustrates a blocking body in the folded state.

FIG. 1 shows a blocking body 1 in the folded state (transport state) for example for delivering the blocking body 1 by means of a projectile, not shown in more detail. In the Example shown, the blocking body 1 has four means 2, preferably spikes or dagger-like blades of metal or another dimensionally stable material, which means have a common base 3. These blades 2 are preferably provided on their surface with barbs 4, in order to make it more difficult to pull them out in the activated state. Alternatively all types are possible that enable the blades 2 to remain in the tire.

At the base end a rope or cable 6 is provided that is wound around the base 3. The rope 6 is provided with a claw 7 at one end. In the active state (FIG. 2) the four blades 2 are orientated with respect to one another such that three of the blades 2 with their tips 2.1 form the vertices of a tetrahedron. By these means the blocking body 1 can always arrive on a surface 8 in the same orientation, wherein three tips 2.1 form the contact points 9. The fourth blade 2 then faces upwards. The surface 8 should preferably be flat.

The blades 2 that form the tetrahedron are fastened on three sides of a base plate 11 of the blocking body 1 via hinges 10. This base plate 11 should be triangular for this embodiment. In the hinges 10, means are situated that pivot the three lateral blades 2 into the activation position, in which they then lock. These means can for example be leg springs. The fourth of the blades 2 is fixed to the upper face of the base plate 11 and since it does not need to be pivoted, can be fastened permanently at angles to the base plate 11.

In the transport state (FIG. 1) the three lateral blades 2 are pivoted upwards against the force of the leg springs, so that the tips 2.1 of all blades 2 lie in one plane. There they are secured against pivoting out of place by a detachable strip or a slip-off cover (not shown in more detail). When the blocking body 1 is delivered by means of a projectile, the cover can be the actual projectile body.

The rope/cable 6 (steel, Kevlar® etc.) is preferably fastened to the underside of the base plate 11 or to one of the blades 2. Kevlar® is a registered trademark of DuPont™. Kevlar® pertains to aramid fiber that consists of long molecular chains produced-from poly-paraphenylene terephthalamide.

Figure 2:
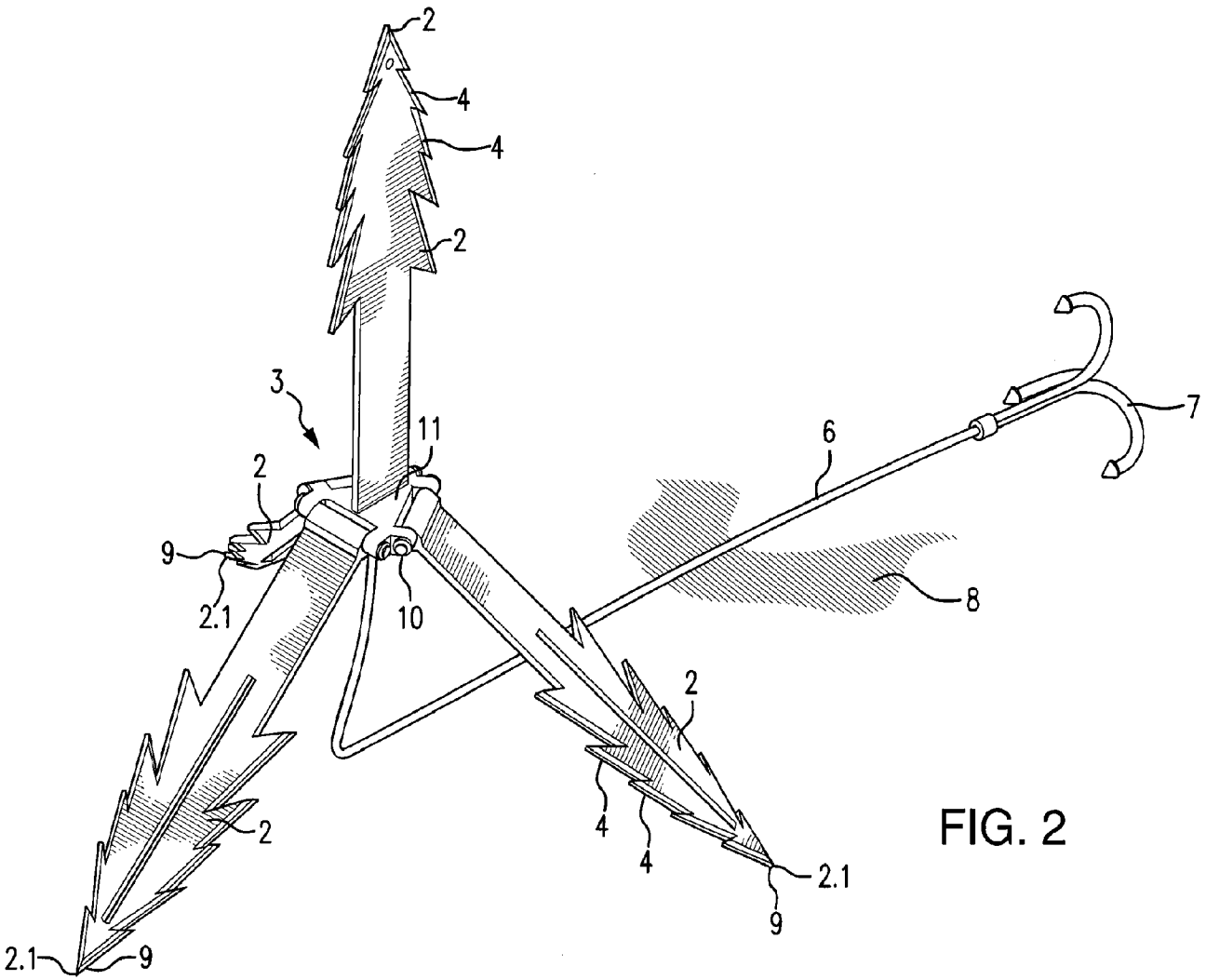
FIG. 2, which illustrates the blocking body in the unfolded state.

In a further variant indicated in FIG. 2, the fourth blade 2 orientated upwards exhibits a type of hole 2.2 from the tip 2.1 up, that then runs laterally.

The mode of operation is as follows:

The blocking body 1 is discharged, for example after ascertaining a direction of movement of a vehicle, not shown in more detail. The blades 2 are released at the latest as the blocking body 1 impacts. The blocking body 1 takes up its position via the three lateral blades 2, with the fourth blade 2 being orientated upwards.

As the blocking body 1 is run over, this upright spike or the fourth blade 2 penetrates the tire and remains stuck there (not shown in more detail).

With a possible further rotation of the wheel, the claw 7 situated on the blocking body 1 becomes entangled on the axis arms and leads to a further restriction of the mobility of the vehicle.

If the blade 2 pointing upwards has in addition a hole 2.2, through which a tubule is simulated, a sufficient escape of air from the wheel is ensured, which entails a further restriction of the mobility.

It should be pointed out that three blades 2 have proved to be sufficient to orientate the blocking body 1. However, more than only four blades 2 can also be incorporated in the blocking body 1, wherein also several of the blades 2 can then be pressed into the tire and the blocking body 1 comes to lie/stand not only on three blades 2. The base plate would need to be adapted accordingly.

The invention claimed is:

1. A blocking body for restricting the mobility of a vehicle having wheels, wherein the blocking body comprises:

(a) at least four members, each member having a tip; and (b) a common base, wherein the at least four members are pivotally connected to the common base so as to be foldable into a transport state and into an active state, wherein when the blocking body is folded into the transport state the at least four members are pivoted upwards from the base so that the tips of each one of the at least four members lie in one plane, and when the blocking body is folded into the active state the at least four members are orientated so that at least three tips of the at least four members form contact points on a surface and at least the fourth member points upwards from the surface so as penetrate one of the wheels of the vehicle having wheels when the blocking body is run over by the one wheel of the vehicle having wheels.

2. A blocking body according to claim 1, wherein each one of the at least four members is a blade or spike that has a surface that causes the blade or spike to remain in the wheel penetrated by the blade or spike.

3. A blocking body according to claim 2, wherein each one of the at least four members is are provided with a surface having barbs.

4. A blocking body according to claim 1, wherein each one of the at least four members are composed of metal or another dimensionally stable material.

5. A blocking body according to claim 1, wherein each one of the at least four members is fastened to a base plate, wherein the common base comprises the base plate.

6. A blocking body according to claim 1, wherein each of the at least four members has a hole that forms a tubule.

7. A blocking body according to claim 1, wherein the blocking body is deployable from the transport state to the active state by either manually laying out the blocking body from the transport state to the active state or by shooting the blocking body using a throwing unit.

8. A blocking body according to claim 2, wherein each of the at least four members are composed of metal or another dimensionally stable material.

9. A blocking body according to claim 3, wherein each of the at least four members are composed of metal or another dimensionally stable material.

10. A blocking body according to claim 2, wherein each one of the at least four members is fastened to a base plate, wherein the common base comprises the base plate.

11. A blocking body according to claim 3, wherein each one of the at least four members is fastened to a base plate, wherein the common base comprises the base plate.

12. A blocking body according to claim 4, wherein each one of the at least four members is fastened to a base plate, wherein the common base comprises the base plate.

13. A method for restricting the mobility of a vehicle having wheels, wherein the method comprises the steps of:

(a) ascertaining direction of movement of the vehicle having wheels, and then discharging the blocking body according to claim 1; and (b) releasing the at least four members at the latest at impact of the blocking body onto a surface so that the blocking body unfolds into the active state and into a first position, wherein at least one of the at least four members is orientated upwards relative to the surface.

14. A method according to claim 13, wherein each one of the at least four members of the blocking body is a blade.

15. A blocking body for restricting the mobility of a vehicle having wheels, wherein the blocking body comprises:

(a) at least four members, each member having a tip, wherein each one of the at least four members is fastened to a base plate; and (b) a common base, wherein the common base comprises the base plate and wherein the at least four members are pivotally connected to the common base so as to be foldable into a transport state and into an active state, wherein when the blocking body is folded into the transport state the at least four members are pivoted upwards from the base so that the tips of each one of the at least four members lie in one plane, and when the blocking body is folded into the active state the at least four members are orientated so that at least three tips of the at least four members form contact points on a surface and at least the fourth member points upwards from the surface so as penetrate one of the wheels of the vehicle having wheels when the blocking body is run over by the one wheel of the vehicle having wheels, and wherein three members of the at least four members are fastened laterally to the base plate and in a swung-open position of the active state form a tetrahedron, and the fourth member is attached to an upper face of the base plate.

16. A blocking body according to claim 15, wherein the three laterally attached members are fastened to the base plate via hinges.

17. A blocking body according to claim 16, wherein leg springs are situated in the hinges, and the springs pivot the three members from the transport state into the swung-open position of the active state, and then the three members lock at the swung-open position so as to maintain the active state.

18. A blocking body for restricting the mobility of a vehicle having wheels, wherein the blocking body comprises:

(a) at least four members, each member having a tip, wherein each one of the at least four members is fastened to a base plate;

(b) a common base, wherein the common base comprises the base plate and wherein the at least four members are pivotally connected to the common base so as to be foldable into a transport state and into an active state, wherein when the blocking body is folded into the transport state the at least four members are pivoted upwards from the base so that the tips of each one of the at least four members lie in one plane, and when the blocking body is folded into the active state the at least four members are orientated so that at least three tips of the at least four members form contact points on a surface and at least the fourth member points upwards from the surface so as penetrate one of the wheels of the vehicle having wheels when the blocking body is run over by the one wheel of the vehicle having wheels; and (c) a rope or cable having ends, and a base end of the rope or cable is wound around the common base, and a claw is provided at a free end of the rope or cable.

19. A blocking body according to claim 18, wherein the rope or cable is fastened to an underside of the base plate or to one of the at least four members.

20. A blocking body according to claim 18, wherein the rope or cable is made of a material selected from the group consisting of steel and Kevlar.

* * * * *